US007251198B2

(12) United States Patent
Barton

(10) Patent No.: US 7,251,198 B2
(45) Date of Patent: Jul. 31, 2007

(54) MOON PHASE WHEEL CHART

(76) Inventor: Sean Anderson Barton, 507 E. Jefferson St., Quincy, FL (US) 32351

( * ) Notice: Subject to any disclaimer, the term of this patent is extended or adjusted under 35 U.S.C. 154(b) by 241 days.

(21) Appl. No.: 11/056,610

(22) Filed: Feb. 11, 2005

(65) Prior Publication Data

US 2005/0174890 A1 Aug. 11, 2005

Related U.S. Application Data

(60) Provisional application No. 60/543,478, filed on Feb. 11, 2004.

(51) Int. Cl.
*G04B 19/26* (2006.01)

(52) U.S. Cl. ..... 368/18

(58) Field of Classification Search ..... 368/15, 368/16, 17, 18, 19, 20, 28
See application file for complete search history.

(56) References Cited

U.S. PATENT DOCUMENTS 1,153,492 A * 9/1915 Hoitinga ..... 368/16
1,997,511 A * 4/1935 Canepa ..... 368/18
3,248,866 A * 5/1966 Spilhaus ..... 368/19
3,290,799 A * 12/1966 Eisenhauer ..... 434/285
3,745,313 A * 7/1973 Spilhaus ..... 235/88 R
D254,124 S * 2/1980 Greenfield ..... D10/6
4,692,031 A * 9/1987 Kaneko et al. ..... 368/18
5,353,264 A * 10/1994 Corbin, III ..... 368/19
5,974,001 A * 10/1999 Barton ..... 368/18
6,272,076 B1 * 8/2001 Dinger ..... 388/15
2003/0095475 A1 * 5/2003 Goldberg ..... 368/15
2003/0099159 A1 * 5/2003 Herbstman et al. ..... 368/77
2004/0141422 A1 * 7/2004 Fitchet ..... 368/18

* cited by examiner

*Primary Examiner*—Vit Miska
*Assistant Examiner*—Sean Kayes
(74) *Attorney, Agent, or Firm*—Peter Loffler

(57) ABSTRACT

A moon phase wheel chart for determining the phase of the moon for a particular date, past, present, or future, has three wheel members adapted to rotate about a common center. The first wheel member has in its center indicia representing the phases of the moon and has around its circumference indicia representing the century. The second wheel member has in its center a first transparent window and has around its circumference indicia representing the year for aligning with the century indicia of the first member and indicia representing the month of the year. The third wheel member has in its center a second transparent window and has around its circumference an indicator for aligning with the month indicia of the second member and indicia for representing the day of the calendar month for aligning with the moon phase indicia of the first member.

16 Claims, 4 Drawing Sheets

MOON PHASE WHEEL CHART

This application for patent is submitted by Sean Anderson Barton, resident of Quincy, Fla., citizen of the United States. This application claims benefit of Provisional Application No. 60/543,478 filed Feb. 11, 2004.

BACKGROUND OF THE INVENTION

The present invention relates to moon phase wheel chart for manually calculating the phase of the moon for a particular date.

Moon phase wheel charts or moon phase devices that can determine the moon phase for a particular date are known in the art. U.S. Pat. No. 5,974,001 to Barton, U.S. Pat. No. 4,692,031 to Kaneko et al., and U.S. Pat. No. D254,124 to Greenfield are examples of devices that are capable of such a task. However, the problem with these devices is that they are relatively complex or bulky machines that are complex in design and are relatively difficult to manufacture, maintain, and store.

Therefore, there is a need in the art for a device that can quickly and accurately determine the phase of the moon for a particular date such that the device is not unduly complex or bulky and is relatively inexpensive to build. Such a device should be relatively simple to operate and should be able to calculate the moon phase for dates past, present, and future.

BRIEF SUMMARY OF THE INVENTION

The moon phase wheel chart of the present invention addresses the aforementioned needs in the art. The moon phase wheel chart provides for a device that accurately calculates the phase of the moon for a particular date and is of relatively simple design and construction and is relatively easy to use.

The moon phase wheel chart is comprised of three wheel members adapted to rotate about a common center. The first wheel member has in its center indicia representing the phases of the moon and has around its circumference indicia representing the thousands and hundreds digits of the year. The second wheel member has in its center a first transparent window and has around its circumference a first opaque ring having an outer side with indicia thereon representing the tens and ones digits of the year and an inner side with indicia thereon representing the months of the year. The third wheel member has in its center a second transparent window and has around its circumference a second opaque ring having an outer side with an indicator thereon for aligning with the month indicia of the second member and an inner side with indicia thereon representing the days of the calendar month.

DETAILED DESCRIPTION OF THE INVENTION

Figure 1:
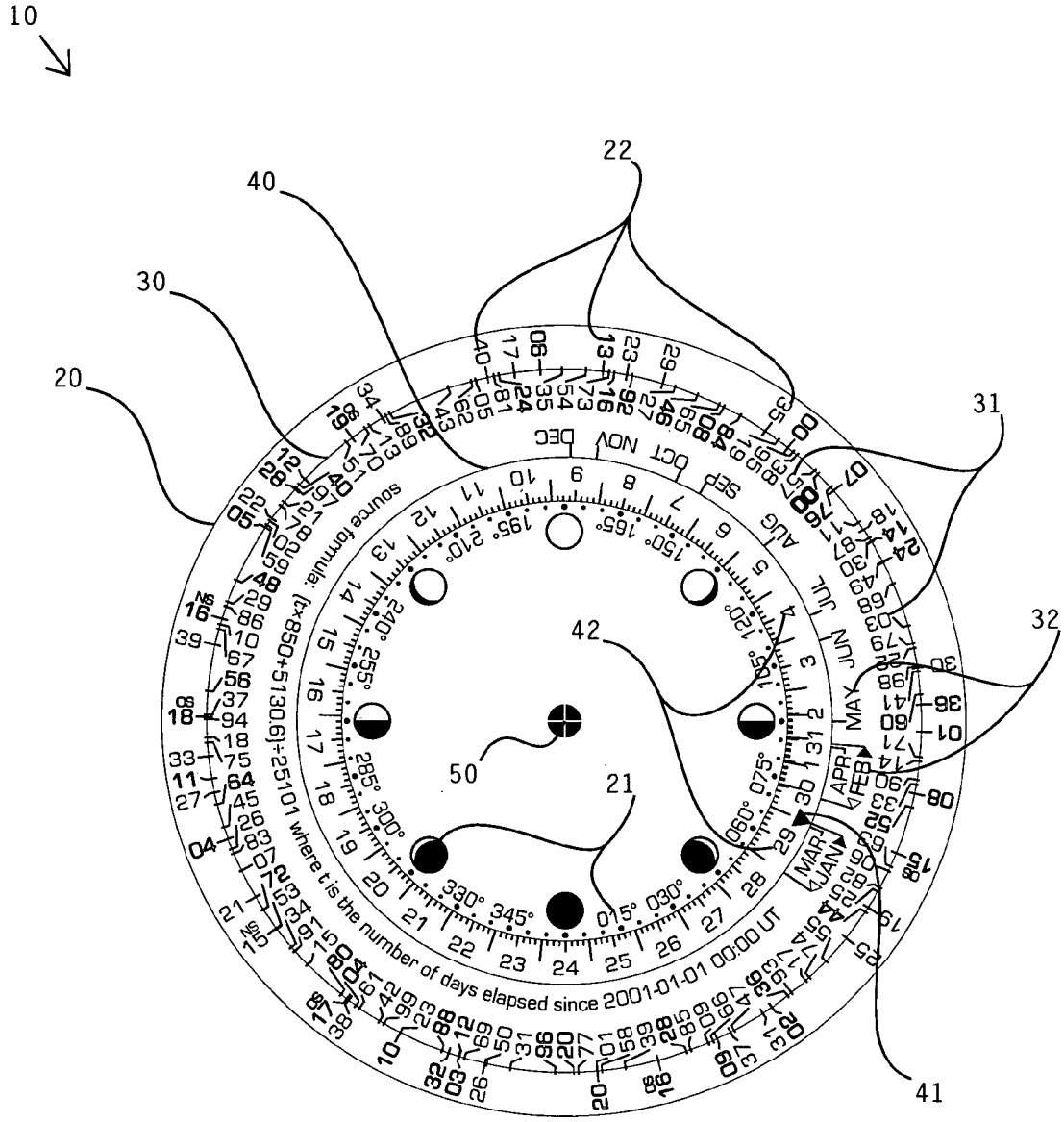
FIG. 1 is a top elevation view of the moon phase wheel chart.
Figure 2:
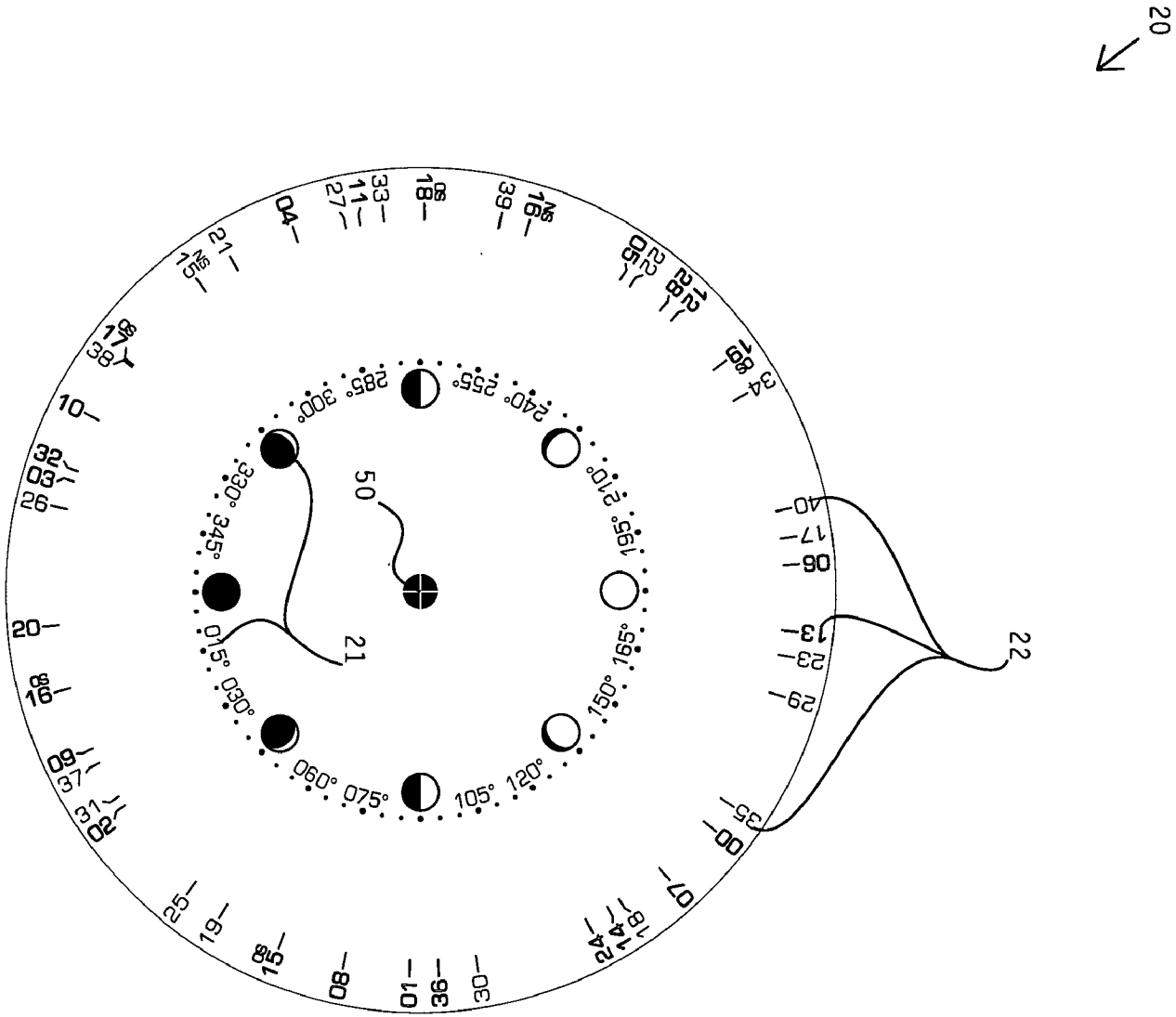
FIG. 2 is a top elevation view of the first wheel member of the moon phase wheel chart.
Figure 3:
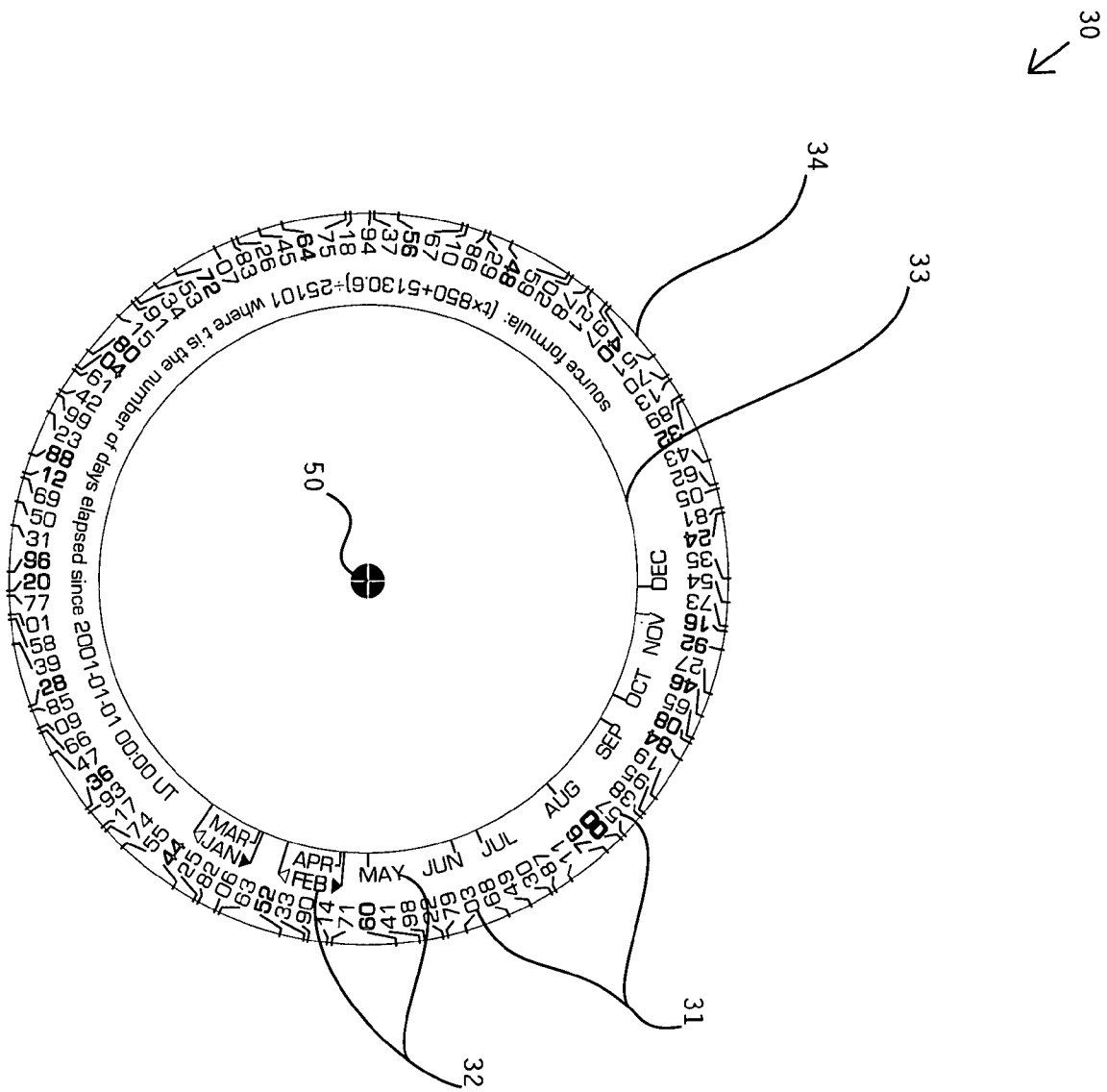
FIG. 3 is a top elevation view of the second wheel member of the moon phase wheel chart.
Figure 4:
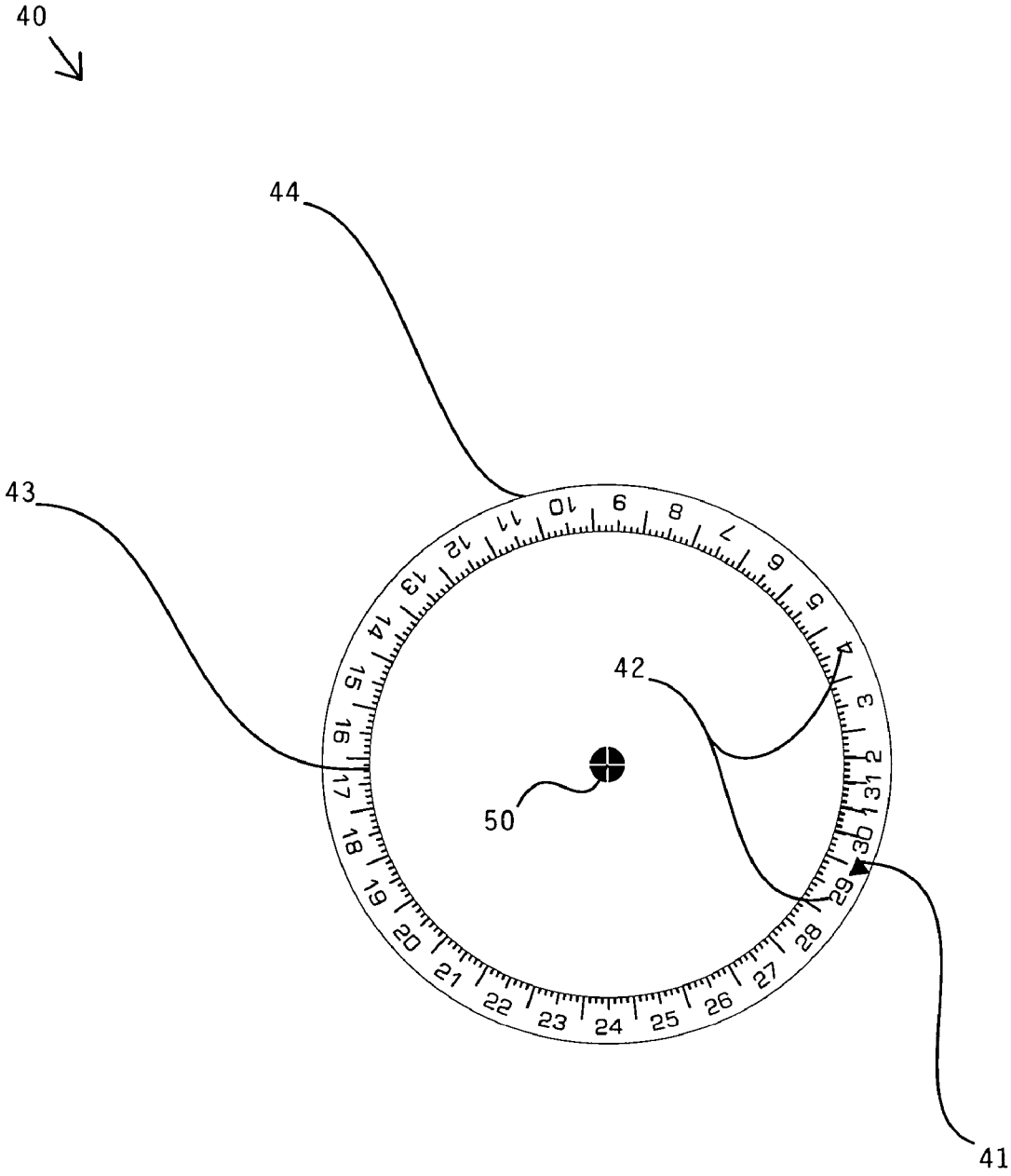
FIG. 4 is a top elevation view of the third wheel member of the moon phase wheel chart.

Referring now to the drawings, it is seen that the moon phase wheel chart of the present invention, generally denoted by reference numeral 10, is comprised of a first wheel member 20, a second wheel member 30 atop the first wheel member 20, and a third wheel member 40 atop the second wheel member 30. The first wheel member 20, the second wheel member 30, and the third wheel member 40 are adapted to rotate about a common center 50. As seen, each wheel member 20, 30, and 40 has a generally circular shape.

As seen, the first wheel member 20 has in its center a plurality of first indicia 21 representing the phases of the moon and has around its circumference a plurality of second indicia 22 representing the thousands and hundreds digits of the year. The second wheel member 30 has in its center a first transparent window 33 and has around its circumference a first opaque ring 34 having an outer side with a plurality of third indicia 31 thereon representing the tens and ones digits of the year for aligning with the second indicia 22 of the first wheel member and having an inner side with a plurality of forth indicia 32 thereon representing the months of the year. The third wheel member 40 has in its center a second transparent window 43 and has around its circumference a second opaque ring 44 having an outer side with an indicator 41 thereon for aligning with the forth indicia 32 of the second wheel member and having an inner side with a plurality of fifth indicia 42 thereon representing the days of the calendar month for aligning with the first indicia 21 of the first wheel member.

The plurality of second indicia 22 are of two colors to distinguish centuries that are leap centuries containing 36525 days and centuries that are nominal centuries containing 36524 days. The plurality of third indicia 31 are of three colors to distinguish years that are leap years containing 366 days, years that are nominal years containing 365 days, and years that are either nominal or leap depending on weather the century is nominal or leap. The indicator of the third wheel member may be comprised of a plurality of indicia allowing one to choose a particular time zone instead of Greenwich time. The forth indicia and fifth indicia may be of several colors to indicate the number of days in each calendar month.

In order to use the moon phase wheel chart 10 of the present invention, the second wheel member 30 is rotated so that the third indicia 31 representing the tens and ones digits of the year of interest is aligned with the second indicia 22 representing the thousands and hundreds digits of the year of interest. The third wheel member 40 is then rotated so that the indicator 41 is aligned with the forth indicia 32 representing the month of interest. There are two possible ways to make this alignment for January or February. The proper alignment is determined by weather the year is nominal or leap and is accomplished by aligning with the forth indicia 32 that is of the same color as the third indicia 31 of interest unless a matching color is not available. In this case one must match the color of the second indicia 22 instead of the third indicia 31. By way of example, FIG. 1, illustrates the phases of the moon for the month of January in the year 2001.

Alternately, the moon phase device 10 may be composed of two wheel members instead of three such that the device is limited to calculating the phase of the moon during a much shorter duration of time, perhaps only one hundred years.

I claim:

1. A moon phase wheel chart, for determining the phase of the moon for a particular date, comprising:

a first member, a second member, and a third member, each of a generally circular shape adapted to rotate about a common center; where.

the first member has at least one first indicia thereon located a constant first radii from the common center, each of the flint indicia representing a particular phase of the moon, and at least one second indicia thereon located a constant second radii from the common center, each of the second indicia represesnting a particular thousands and hundreds digit of a year;

the second member is atop the first member and has at least one third indicia thereon located a constant third radii from the common center, each of the third indicia representing a particular tens and ones digit of the year and at least one forth indicia thereon located a constant forth radii from the common center, each of the fourth indicia representing a particular month of the year;

the third member is atop the second member and has at least one fifth indicia thereon located a constant fifth radii from the common center, each of the fifth indicia representing a particular day and a sixth indicia thereon; and such that for a month and a year of interest, the second member is rotated so that the respective third indicia that we resents the tens digit and ones digit of the ear of interest is aligned with the respective second indicia that represents the thousands digit and the hundreds digit of the year of interest, the third member is rotated so that sixth indicia is aligned with the fourth indicia that represents the month of interest whereby each of the first indicia are now properly aligned with each of the fifth indicia thereby showing the moon phase for each of the days of the month and year of interest.

2. The moon phase wheel chart as in claim 1, wherein the second member and the third member are generally transparent.

3. The moon phase wheel chart as in claim 1, wherein the first indicia, the second indicia, the third indicia, the forth indicia, the fifth indicia, and the sixth indicia are of several colors.

4. The moon phase wheel chart as in claim 1 wherein the first indicia are graphic in nature.

5. The moon phase wheel chart as in claim 1 wherein the first indicia are numeric in nature.

6. The moon phase wheel chart as in claim 1 wherein the first indicia are both graphic and numeric in nature.

7. The moon phase wheel chart as in claim 1 wherein of the respective fourth indicia that represents the month of January and the respective fourth indicia that represents the month of February each have a first alignment position and a second alignment position such that the sixth indicia is aligned with the first alignment position if the year of interest is nominal and the sixth indicia is aligned with the second alignment position if the year of interest is leap, if the month of January or the month of February is the month of interest.

8. The moon phase wheel chart as in claim 7 wherein the respective second indicia that correspond to centuries that are leap centuries are of a first color and the remainder of the second indicia are of a second color.

9. The moon phase wheel chart as in claim 8 wherein the respective third indicia that correspond to years that are only leap years are of a third color, the respective third indicia that correspond to years that are only nominal years are of a fourth color and the remainder of the third indicia are of a fifth color.

10. The moon phase wheel chart as in claim 7 wherein the respective third indicia that correspond to years that are only leap years are of a first color, the respective third indicia that correspond to years that are only nominal years are of a second color and the remainder of the third indicia are of a third color.

11. The moon phase wheel chart as in claim 1 wherein the first radii is smaller relative to the second radii.

12. The moon phase wheel chart as in claim 11 wherein the fourth radii is smaller relative to the third radii.

13. The moon phase wheel chart as in claim 12 wherein the first radii is smaller relative to the fourth radii.

14. The moon phase wheel chart as in claim 13 wherein the third radii is smaller relative to the second radii.

15. The moon phase wheel chart as in claim 14 wherein the fifth radii is smaller relative to the fourth radii.

16. The moon phase wheel chart as in claim 15 wherein the first radii is smaller relative to the fifth radii.

* * * * *